United States Patent [19]

Lambert

[11] Patent Number: 4,541,214

[45] Date of Patent: Sep. 17, 1985

[54] PERGOLAS

[76] Inventor: Daryl J. Lambert, 13 Toolaby Ave., Beaumont, South Australia, 5066, Australia

[21] Appl. No.: 550,887

[22] Filed: Nov. 10, 1983

[30] Foreign Application Priority Data

Nov. 12, 1982 [AU] Australia ..... 21134/83

[51] Int. Cl.[4] ..... E06B 7/08

[52] U.S. Cl. ..... 52/473; 47/31; 52/342; 52/507; 98/100.5

[58] Field of Search ..... 52/473, 78, 507, 342; 47/31, 28; 98/88 L

[56] References Cited

U.S. PATENT DOCUMENTS

| | | | |
|---|---|---|---|
| 1,107,907 | 8/1914 | Crambaugh | 52/342 |
| 2,320,268 | 5/1943 | Cramer | 98/88 L |
| 2,555,472 | 6/1951 | Lilly | 98/88 L |
| 2,597,225 | 5/1952 | Ckrosnik | 52/78 |
| 4,160,341 | 7/1979 | Drake | 47/31 |

FOREIGN PATENT DOCUMENTS

| | | | |
|---|---|---|---|
| 3011905 | 10/1980 | Fed. Rep. of Germany | 52/309.14 |
| 1477753 | 3/1967 | France | 52/473 |

*Primary Examiner*—Henry E. Raduazo

*Attorney, Agent, or Firm*—Pearne, Gordon, Sessions, McCoy, Granger & Tilberry

[57] ABSTRACT

A pergola having a top comprising a plurality of wooden strips aligned in parallel relationship with a bottom planar face inclined to the mutually parallel side faces so as to provide a support orientation easily determinable and effective to provide differential shading from the sun by reason of the change in inclination of the sun during the seasons of the year.

4 Claims, 16 Drawing Figures

PERGOLAS

Figure 2:
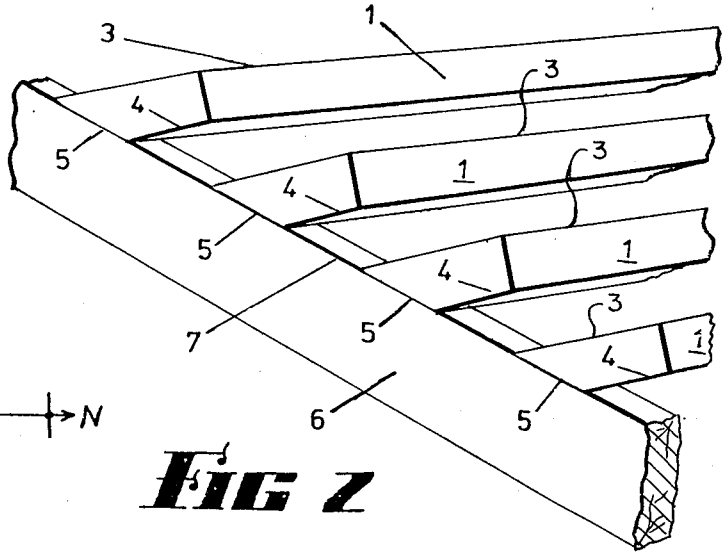

This invention relates to pergolas.

A difficulty to which this invention is directed relates to enabling persons who may not be highly skilled in construction of wooden assemblies, to construct a pergola which can provide relative to selected orientations with respect to the earths surface, effective control of the amount of sun or shade that can be permitted to pass through the pergola during variation of the axis of the sun during the seasons of the year.

A further problem to which this invention is directed is to enable a kit of parts to be supplied which can be very economically manufactured and supplied and yet will at the same time provide members which can be accurately located and installed by even the least skilled purchaser for home assembly.

A further aspect of this invention relates to the appearance of a pergola having seasonal light control characteristics, and to the problem of insuring that this, while being economical, can provide a good appearance from an aesthetic point of view.

The invention can be said to reside in a pergola having light control members comprising a plurality of wooden strip, each strip being of constant cross-sectional size and shape along its length and each strip aligned in parallel relationship with adjacent strips, each strips being located a distant apart from immediately adjacent strips, the shape of strip in cross-section including two side planar faces parallel one with the other and a bottom planar face inclined to the planar faces of the sides, at least two spaced apart bearers supporting the strips and aligned in a tranversely orientated alignment with respect to the direction of elongation of the strips, each strip resting on the bearers with its bottom planar face adjoining an uppermost edge of each bearer and aligning the strip thereby, the angle of inclination of each strip, the thickness of each strip, the depth of each strip, and the distant apart of each strip being selected so that at least if the pergola top is supported in a selected orientation with respect to the axis of the earth, the rays of the sun will be substantially blocked by the strips at least during the period of the seasons that the sun is at its highest inclination but allow a substantial proportion of the rays of the sun to pass therebetween during the period of the seasons when the sun is at its lowest inclination.

Preferably the angle of inclination between the planar faces of the sides and the planar face of the bottom lies between 15 degress and 75 degrees.

Obviously the preferred angle of inclination will have to be selected having due regard to the latitude of the location on the earths surface that the pergola is to be used.

Preferably the top face of each of the wooden strips is a planar face which is perpendicular to the planar faces of the sides.

Preferably each strip is secured to the respective bearer by a nail or nails passing through from a side of the strip, through the bottom of the strip and into the bearer.

Preferably each of the wooden strips is identical in respect of cross-sectional shape and size.

Accordingly there is significant advantage in the use of a plurality of strips each of generally rectangular sides with however a lowermost edge or bottom edge having an inclined angle. This is cut so that, with respect to a bearer, the location of which can be accurately ascertained with respect to the horizontal by even an unskilled person, the orientation is fixed. The angle of each of the strips coupled with its other aspects including thickness and depth and separation from others will ensure that provided that the assembler simply keeps the separation gap between respective strips consistent the pergola can be usefully accurate and provide the function required.

Furthermore, where a kit can be supplied having the same bottom inclination angle of each strip the effect when in a pergola can be varied to take account of difference in latitude of erection by change of the separation distance of each of the strips one from the other.

Further, using strips in the manner discussed, the nailing of timber strips where the grain angle will normally be longitudinal and the direction of a nail securing the strip to an underneath bearer is easily secured even by those only modestly competent with a hammer and nails.

Figure 3:
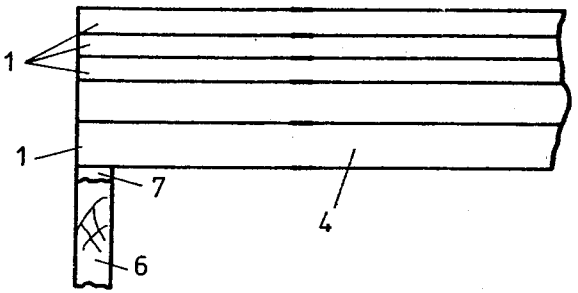
Figure 4:
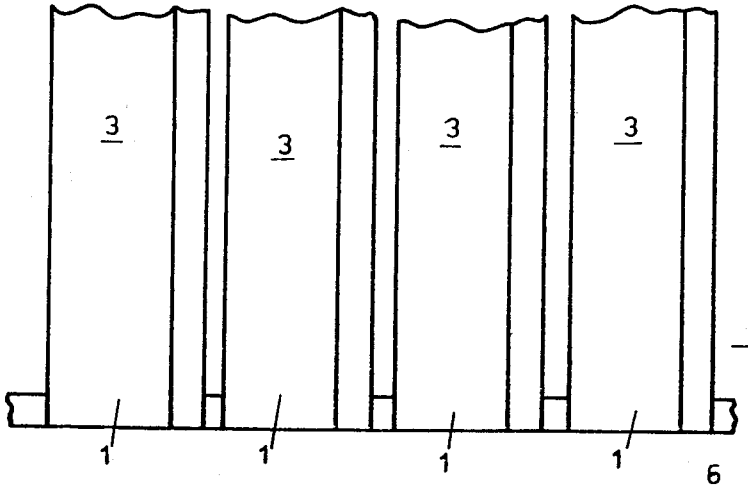
Figure 1:
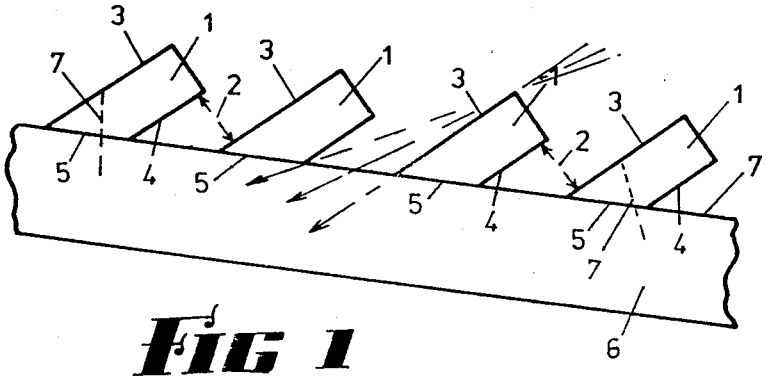
Figure 8:
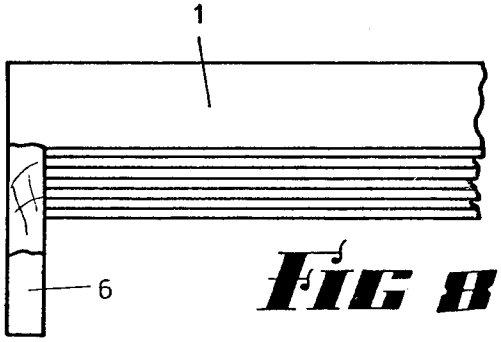
Figure 5:
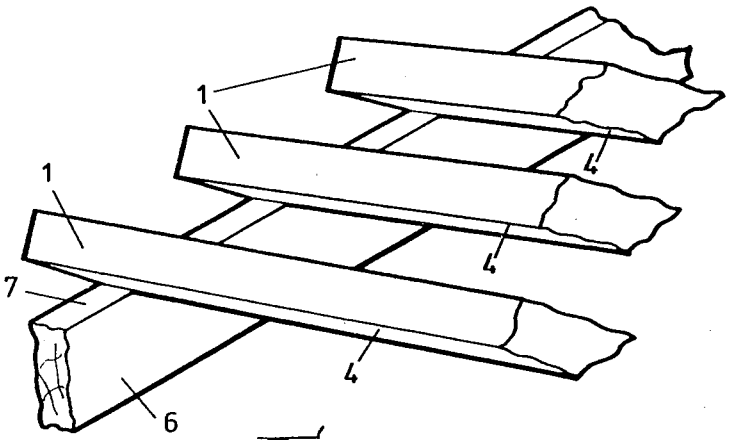
Figure 7:
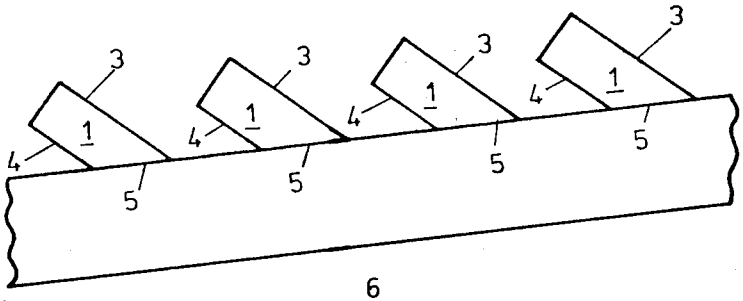
Figure 6:
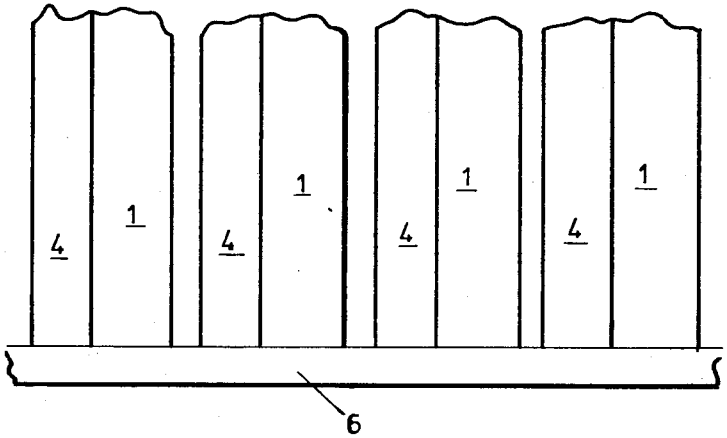
Figure 11:
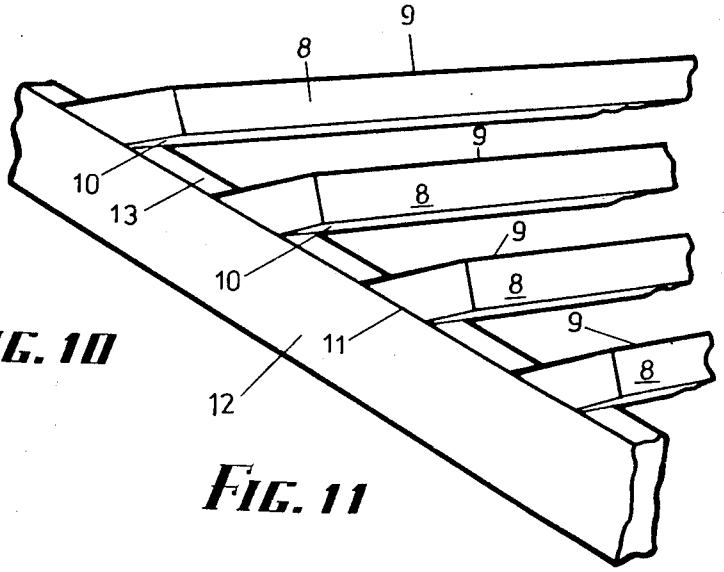
Figure 12:
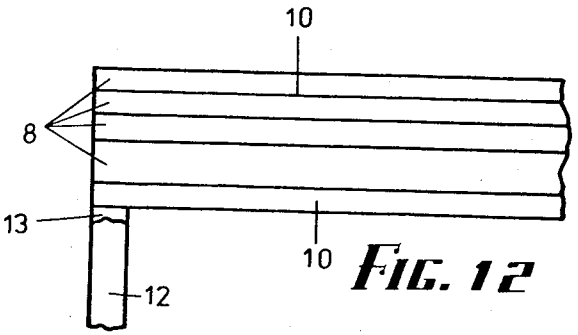
Figure 10:
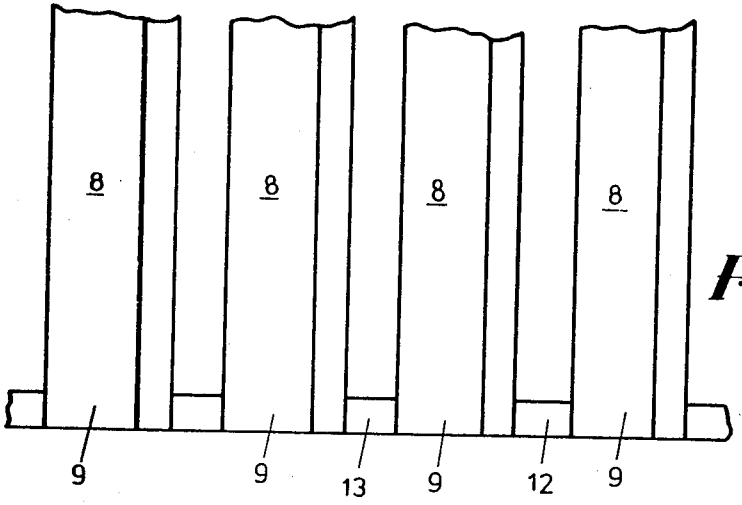
Figure 9:
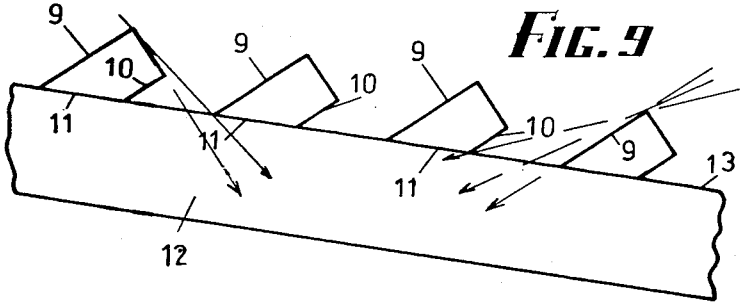

For a better understanding of this invention it will be described with respect to two preferred embodiments which will now be described with the assistance of drawings in which:

FIG. 1 is a side elevation of a part of an assembled pergola top according to the first embodiment, FIG. 2 is a perspective view of the portion of the pergola top as in Fig. 1, FIG. 3 is a front view of the pergola top portion as shown in FIG. 1, FIG. 4 is a view from above of the pergola top portion as shown in FIG. 1, FIG. 5 is a perspective view from another angle of the pergoloa top portion of FIG. 1, FIG. 6 is an underneath view of the pergola top portion as shown in FIG 1, FIG. 7 is a side elevation from the other end of the pergola top portion as shown in FIG. 1, FIG. 8 is a view from the other side of the pergola top portion than that shown in FIG. 3 of the portion shown in FIG. 1, FIG. 9 is a side elevation of a second embodiment, FIG. 10 is a plan view of the same portion of the embodiment as shown in FIG. 9, FIG. 11 is a perspective view of the portion of the second embodiment as shown in FIG. 9, FIG. 12 is an end view of the portion of the embodiment as shown in FIG. 9

Figure 14:
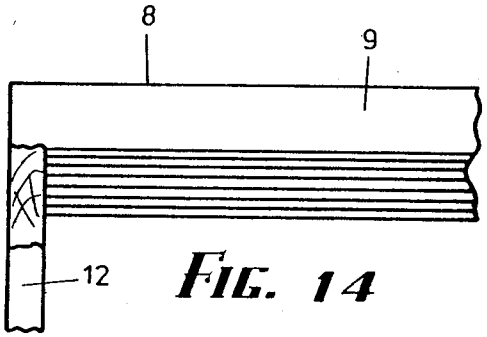
Figure 16:
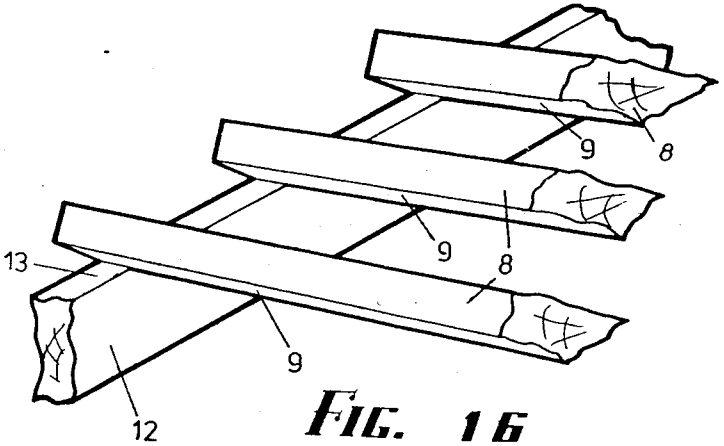
Figure 13:
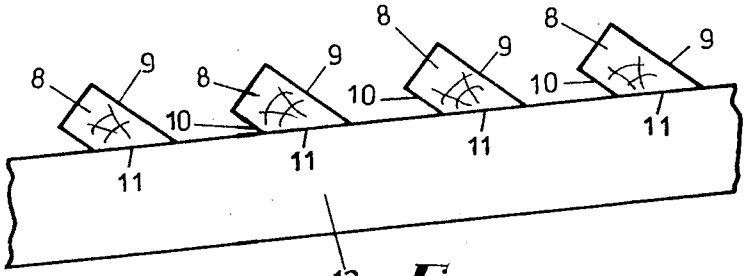
Figure 15:
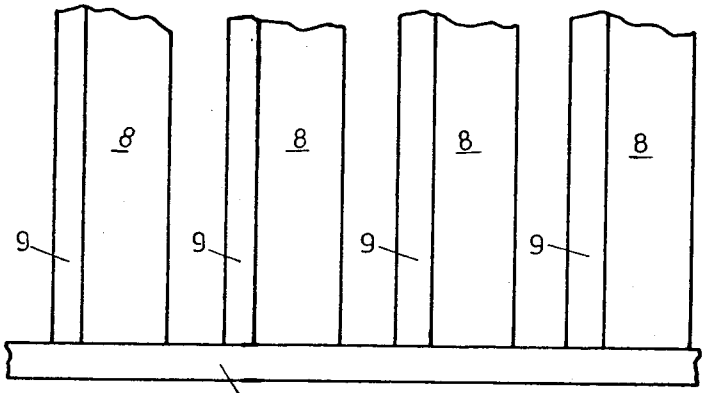

FIG. 13 is a side elevation from the opposite side once again of the same portion of the second embodiment as shown in FIG. 9, FIG. 14 is an end view of the portion of the second embodiment as shown in FIG. 9, FIG. 15 is and underneath view of the portion of the embodiment as shown in FIG. 9, FIG. 16 is a perspective view of the portion of the embodiment as shown in FIG. 9 from another angle.

Referring in detail to the drawings, and in particular to the first embodiment as shown in FIGS. 1 through 8 this comprises a plurality of timber strips 1 each of which is of constant cross-sectional shape along its length and each of which is parallel to adjacent strips.

The distance apart of each of the strips 1 is consistent and the same between respective strips 1 the distance being shown at 2 that is the shortest distance between the respective facing edge of each of the strips the measurement being as shown by the numeral 2.

Obviously small variations in accordance with normal tolerance in the building industry would not be regarded as varying from this requirement but substantial compliance is necessary to ensure uniformity of the effect of controlling the shade or sun levels.

Each of the strips has two oppositely located edges in cross-section at 3 and 4 which are parallel one with respect to the other and in the embodiment the length of edge 3 as shown in FIG. 1 is 100 mm.

The bottom edge 5 of each of the strips 1 is inclined with respect to the edges 3 or 4 and this angle of inclination is such as to provide an accurate means by which the inclination of the strip 1 can be ascertained with respect to the bearer 6.

The bearer 6 is a member of rectangular proportions and has an upper planar surface at 7 so that with the inclined edge of each of the strips 1 resting thereon, this determines the angular relationship of each of the strips 1 with respect to the horizontal.

The means by which each of the strips 1 can be secured to the bearer 6 can be very simple and especially suitable for a handyman or unskilled securement namely by using a nail as shown at 7.

Such affixing means can be achieved very simply because of the open angle between the edge 3 of each strip 1 and the bearer 6 and of course each strip 1 is easily strongly affixed by this securement technique.

The angular relationship of each of the strips 1 to the bearer 6 is directly determined by the angular relationship of the inclined edge 5.

The degree to which sun can be controlled through the pergola will vary because of a number of factors but FIG. 1 which is drawn to scale shows an arrangement which can be extended both by reason of the number of strips and by reason of their length and is intended to be facing due north as is shown specifically in FIG. 4 and the angles as shown have been selected specifically for the latitude appropriate for Adelaide in South Australia.

Different latitudes may be best served by altering either the spacing 2 or the angle of inclination of the bottom edge 5 or indeed some variation can be achieved by altering the angle of inclination of the bearer 6.

With an angle of inclination of the bottom edge 5 with respect to the direction of elongation of the bearer 6 of 40° and with the angle of the bearer with respect to the horizontal being located at 7° it has been found that such an arrangement provides a generally ideal solar control arrangement for a pergola.

Typically in an Adelaide latitude then during a date of approximately late June, (22nd June) at 9 O'clock in the morning there would be 17% sun as compared to shade; at 11 a.m. 46% sun as compared to shade, at 1 p.m. 46% sun as compared to shade and 3 p.m. in the afternoon 30% sun as compared to shade.

Comparing this with the same arrangement during summer on January the 22nd at 9 a.m. there would be 87% shade as compared to sun, 11 a.m. 82% shade as compared to sun, 1 p.m. 82% shade as compared to sun and 3 p.m. 87% shade as compared to sun.

It will be further seen however that by keeping the distance 2 at least equivalent to the distance between the respective edges 3 and 4 of each strip, there is adequate ability to see the sky for those beneath the pergola of at least 50% of the sky which contributes to a good apparent openess below the pergola while providing the necessary shading feature at least during summer to avoid most of the sun reaching the underneath area of the pergola.

Referring to the second embodiment, this is arranged so as to be appropriate for a due west facing location.

There are accordingly strips 8 each of which are of elongated proportions and which in cross-section are of constant cross-sectional shape along their length and which include inclined oppositely, located parallel side edges 9 and 10 and a lowermost edge 11 located at a bottom of each strip 8.

As in the first embodiment there is shown a bearer 12 having an uppermost planar edge 13 upon which each of the strips 8 are resting so that the angle of orientation is determined by the inclined angular relationship of the bottom edge 11 with respect to the remainder portion of the strip 8.

The method of fixing likewise can be simple such as nails located through mutually engaging portions of the strip 8 and the bearer 12.

The angular relationship of the bearer 12 can be varied depending upon the required arrangement.

It will be appreciated that the proportions will be the same regardless of size but in the embodiment, the distance from edge 9 to edge 10 in each strip is 38 mm.

Each of the strips 8 are separated by the same distance and the characteristics of each strip 8 and its angular relationship and separation are selected as shown for best use at a latitude of Adelaide in South Australia.

With the angular relationships and sizes as shown but with the bearer horizontal, experimental tests have shown that on December 22nd with a due west orientation 68% shade is achieved at noon, 73% shade at 1 p.m. 78% shade at 2 p.m. 83% shade at 3 p.m. and total shade at 4 p.m.

With the arrangement shown there is very little difference during the seasons and this can be seen that on February 22nd, at noon 67% shade would be achieved, 1 p.m. 72% shade would be achieved, 2 p.m. 77% shade would be achieved and at 3 p.m. 85% shade would be achieved.

Accordingly we have now shown that in two instances very effective solar control can be achieved where the parts providing this are easily assembled by even unskilled hobbiests while achieving accurate inclinations in the simplest way.

Further, the costs related to the parts can be at a minimum firstly because of the selection of sizes and secondly because by using only one face of any strip providing the inclination, preparation costs apart from standard lengths of timber can be kept to a minimum.

The advantage of being able to vary the distance apart of the strips also adds some latitude to their use with respect to different global latitudes.

The claims defining the invention are as follows:

1. A pergola having light control members comprising a plurality of wooden strip, each strip being of constant cross-sectional size and shape along its length and each strip aligned in parallel relationship with adjacent strips, each strips being located a distant apart from immediately adjacent strips, the shape of strip in cross-section including two side planar faces parallel one with the other and a bottom planar face inclined to the planar faces of the sides, at least two spaced apart bearers supporting the strips and aligned in a tranversely orientated alignment with respect to the direction of elongation of the strips, each strip resting on the bearers with its bottom planar face adjoining an uppermost edge of each bearer and aligning the strip thereby, the angle of inclination of each strip, the thickness of each strip, the depth of each strip, and the distant apart of each strip being selected so that at least if the pergola top is supported in a selected orientation with respect to the axis of the earth, the rays of the sun will be substantially blocked by the strips at least during the period of the seasons that the sun is at its highest inclination but allow a substantial proportion of the rays of the sun to pass therebetween during the period of the seasons when the sun is at its lowest inclination.

2. A pergola as in claim 1 wherein the angle of inclination between the planar faces of the sides and the planar face of the bottom lies between 15 degress and 75 degrees.

3. A pergola as in either of claims 1 or 2 wherein the top face of each of the wooden strips is a planar face which is perpendicular to the planar faces of the sides of each strip.

4. A pergola as in either of claims 1 or 2 wherein each strip is secured to the respective bearer by a nail or nails passing through from a side of the strip, through the bottom of the strip and into the bearer.

* * * * *